United States Patent [19]

Prendergast

[11] 4,373,321

[45] Feb. 15, 1983

[54] SAFETY STIRRUP

[76] Inventor: James P. Prendergast, 29 MacFarlan St., South Yarra, 3141, Victoria, Australia

[21] Appl. No.: 246,002

[22] Filed: Mar. 20, 1981

Related U.S. Application Data

[63] Continuation-in-part of Ser. No. 952,094, Oct. 17, 1978, abandoned.

[51] Int. Cl.[3] ..... B68C 3/00

[52] U.S. Cl. ..... 54/49

[58] Field of Search ..... 54/49

[56] References Cited

U.S. PATENT DOCUMENTS

| | | | |
|---|---|---|---|
| 208,972 | 10/1878 | Freeman | 54/49 |
| 473,075 | 4/1892 | Mayer | 54/49 |
| 970,664 | 9/1910 | Swart | 54/49 |
| 1,082,435 | 12/1913 | Nusser, Jr. | 54/49 |
| 1,102,762 | 7/1914 | Korittke | 54/49 |
| 2,537,532 | 4/1948 | Hrabal | 54/49 |

FOREIGN PATENT DOCUMENTS

| | | | |
|---|---|---|---|
| 160212 | 10/1954 | Australia . | |
| 8177 | of 1888 | United Kingdom | 54/49 |
| 753418 | 7/1956 | United Kingdom . | |

*Primary Examiner*—Paul J. Hirsch
*Assistant Examiner*—Robert P. Swiatek
*Attorney, Agent, or Firm*—Andrus, Sceales, Starke & Sawall

[57] ABSTRACT

The present invention provides a safety device comprising a stirrup, a support for the stirrup itself capable of being attached to a stirrup leather to be supported thereby, one of the stirrup and the support having a projection and the other having an edge whereby in normal use with the edge and projection in engagement the stirrup may depend from the support, a spring clip biasing the stirrup and the support towards one another; and constructed and arranged such that in normal use with force applied to the stirrup by a rider the stirrup will be supported by the support but such that when force is applied to the stirrup at an angle to the support, the stirrup and support will pivot relative to one another against the spring clip until disengagement of the projection and the edge occurs whereupon the stirrup separates from the support.

10 Claims, 10 Drawing Figures

FIG. 8
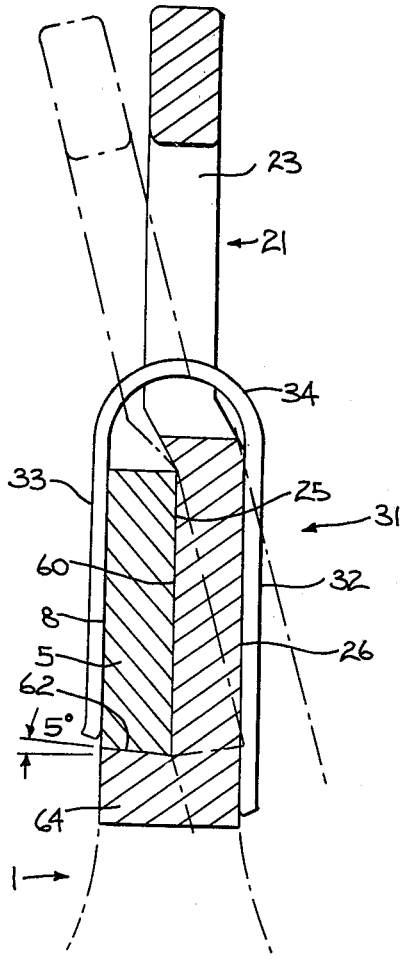
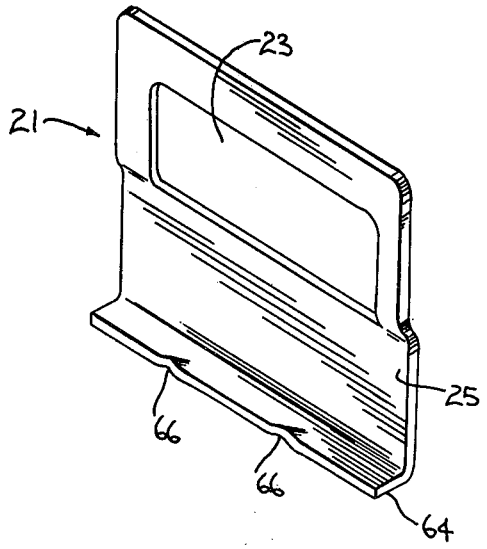
FIG. 9
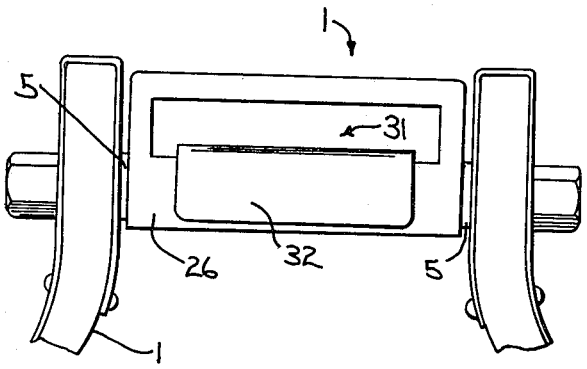
FIG. 10

SAFETY STIRRUP

CROSS REFERENCE TO RELATED APPLICATION

The present application is a continuation-in-part of U.S. patent application Ser. No. 952,094, filed Oct. 17, 1978 and now abandoned.

BACKGROUND OF THE INVENTION—FIELD OF THE INVENTION

This invention relates to stirrups.

SUMMARY OF THE PRESENT INVENTION

There is a need to provide a safety stirrup to avoid or at least reduce the likelihood of a person who falls from a horse having his foot caught by the stirrup and being dragged by the horse.

The present invention provides a safety device comprising a stirrup, a support for the stirrup itself capable of being attached to a stirrup leather to be supported thereby, one of the stirrup and the support having a projection and the other having an edge whereby in normal use with the edge and projection in engagement the stirrup may depend from the support, biasing means biasing the stirrup and the support towards one another; and constructed and arranged such that in normal use with force applied to the stirrup by a rider the stirrup will be supported by the support but such that when force is applied to the stirrup at an angle to the support the stirrup and support will pivot relative to one another against said biasing means until disengagement of the projection and the edge occurs whereupon the stirrup becomes able to separate from the support.

The abutment may be defined by an aperture in said other one of the stirrup and support.

Preferably, the biasing means comprises a spring clip having two legs and a resilient bight joining the two legs.

Preferably, each of the stirrup and the support has a generally planar surface which surfaces, in said normal use, are brought into contact by said biasing means.

In a particularly preferred aspect the present invention provides a safety device comprising a stirrup, a support for the stirrup having a planar surface normally lying closely adjacent to a planar surface at an upper region of the stirrup, and bias means normally constraining the stirrup and the support to lie so closely adjacent.

The support has a portion adapted for connection to a stirrup leather and a lip lying generally normal to the planar surface of the support. The stirrup has an edge adjacent its planar surface lying generally normal thereto. The stirrup is positionable on the support with the edge resting on the lip and the planar surfaces of the support and stirrup in abutment. With the forces applied to the stirrup by the rider in normal use, the stirrup will be supported by the support. But when forces are applied to the stirrup at an angle to the support, as during or after a fall, the stirrup and support will pivot relative to one another against the biasing means until disengagement of the lip and edge occurs whereupon the stirrup separates from the support.

The invention may be applied to stirrups of English style and to stirrups of Western or American style.

BRIEF DESCRIPTION OF THE DRAWING

To aid in the further understanding of this invention, specific embodiments thereof will now be described with the aid of the accompanying drawings in which:

FIG. 8 is a partial cross-sectional view showing another embodiment of the present invention;

FIG. 9 is a perspective view of the support used in the embodiment of the invention shown in FIG. 8; and FIG. 10 is a partial elevational view showing use of the embodiment of FIG. 8 in an American style stirrup.

DETAILED DESCRIPTION OF THE PREFERRED EMBODIMENTS

Figure 1:
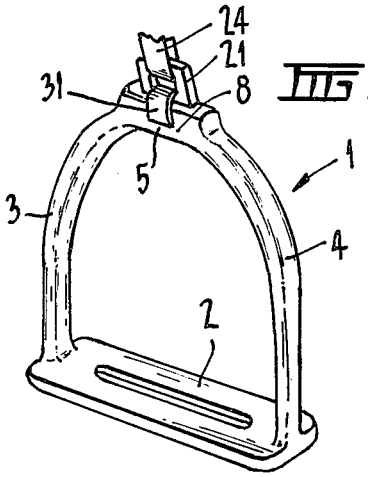
FIG. 1 is a perspective view of one embodiment of a safety device incorporating an English style stirrup from one side.
Figure 2:
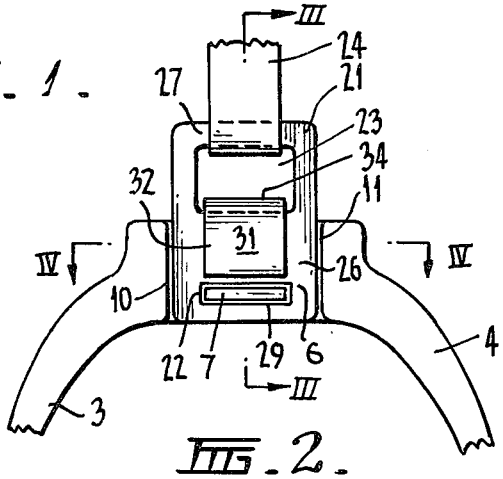
FIG. 2 is a partial elevational view of the device of FIG. 1 but from the other side.

The safety device shown in FIGS. 1–4 comprises a stirrup 1 of English style having a footplace 2, arch arms 3 and 4 and a bight 5.

The device further comprises a support plate 21 having a first aperture 22 and a second aperture 23 through which is threaded a stirrup leather 24.

The device still further comprises a metal spring clip 31 having legs 32 and 33 and a resilient bight 34. The clip 31 is preferably made of spring steel.

The stirrup 2 is generally planar in the region 6 and has a projection 7 extending from the region 6. That projection 7 is generally rectangular and is received within the aperture 22 which is also generally rectangular.

The support 21 is generally planar and its surface 25 lies against region 6.

The bight 34 of the clip 31 passes through the aperture 23 at a distance from the stirrup and support and the legs 32 and 33 are slipped over and biasingly lie on stirrup surface 8 and support surface 26.

It should be noted that the uppermost part 27 of the support 21 lies at an angle of from 2°–15°, preferably 3°–7°, more preferably about 5° to the lowermost part 28 of the support 21. By this angle forces on the footplate 2 are normally directed through the stirrup in a line through the stirrup leather 24.

In use a rider will place his foot on the footplate 2 with the projection 7 directed towards his shin, i.e., with surface 6 adjacent and surface 8 remote from the shin.

When so worn normal riding forces may be applied to and through the stirrup with little chance of accidental release. In this respect it will be noted that the stirrup leather 24 supports the support 21 which, through the side 29 of the aperture, supports the projection 7 and, in turn, the stirrup 1 and that the assembly is maintained together by the clip 31.

Note that side support is provided by shoulders 10 and 11 on the stirrup 1.

Figure 3:
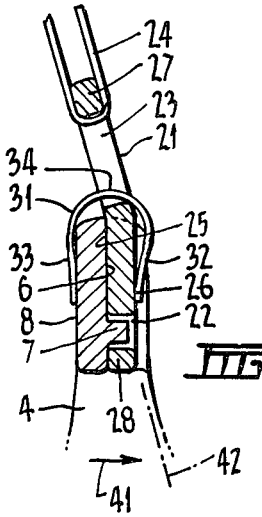
FIG. 3 is a cross-section on line III—III in FIG. 2.
Figure 4:
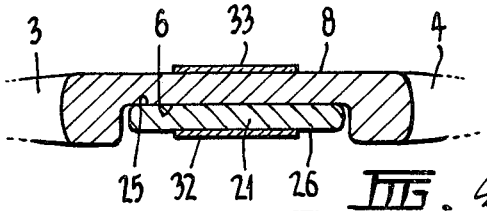
FIG. 4 is a cross-section on line IV—IV in FIG. 2.

However, in a fall situation, particularly a situation in which a rider is in danger of being dragged, a force should be exerted which is out of alignment with the stirrup leather, and which, relative to FIG. 3, is in a rightwards direction as indicated by arrow 41. Such a force should not be exerted in normal use but in the fall situation should occur and will cause displacement of the stirrup 1 to an angle to the support 21 as indicated by line 42 which can be considered to be the release position.

That displacement will withdraw the projection 7 from the aperture 22; a withdrawal which is resisted, but not prevented, by the clip 31. On completion of that withdrawal, at the release position 42, the stirrup 1 becomes free to separate from the plate 21 whereby to safeguard the rider.

Reassembly of stirrup 1, support 21 and clip 31 is easily accomplished.

In a modification of the above the projection 7 may be at a higher location on the stirrup in which case it may be more convenient for the bight 34 to pass between the arch arms 3 and 4 and for the legs 32 and 33 to extend upwardly.

In another modification the projection 7 is on the support 21 and the aperture 22 is in the stirrup 1.

In another modification the legs 32 and 33 extend over the aperture 22.

Figure 5:
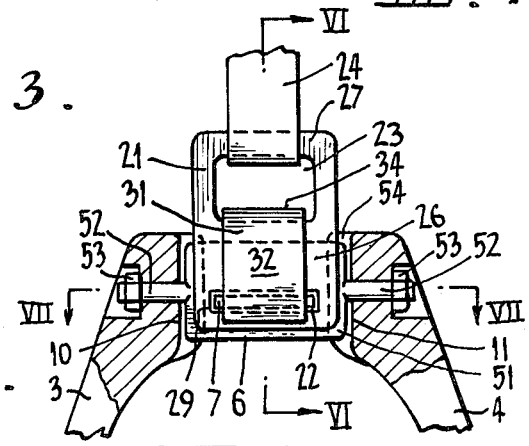
FIG. 5 is a partial elevation view corresponding to FIG. 2 but of a safety device incorporating an American style stirrup.
Figure 6:
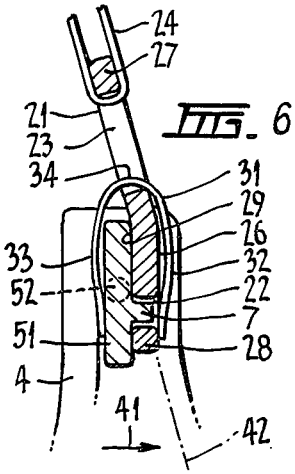
FIG. 6 is a cross-section on line VI—VI in FIG. 5.
Figure 7:
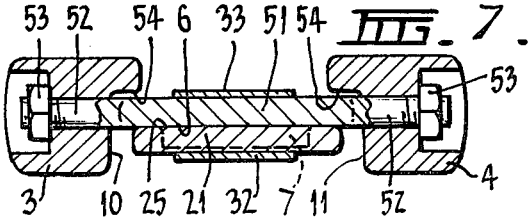
FIG. 7 is a cross-section on line VII—VII in FIG. 5.

FIGS. 5–7 shows the invention applied to an American style stirrup. In FIGS. 5–7 like reference numerals to those of FIGS. 1–4 denote like parts.

The device of FIGS. 5–7 differs principally in that the surfaces 6 and 8 and projection 7 are provided by a body 51 which is secured to the arch arms 3 and 4 by studs 52 and nuts 53, shoulders 10 and 11 are provided on the arch arms 3 and 4 and shoulders 54 are provided to deter the body 51 from tilting relative to the arch arms 3 and 4.

The safety device of FIGS. 5–7 operates in like manner to that of FIGS. 1–4.

FIG. 8 shows another embodiment of the invention, similar elements being identified by the numerals used in FIGS. 1 through 7. Stirrup 1 has planar surface 60 in bight 5 terminating in lower edge 62 lying generally normal to the planar surface. Stirrup support 21 has aperture 23 through which is threaded a stirrup leather. Support 21 has planar surface 25. The lower portion of support 21 is bent to form lip 64 on which edge 62 of bight 5 may rest when planar surfaces 25 and 60 are in abutment. The length of lip 64 may correspond generally to the thickness of the adjacent portion of bight 5. Lip 64 and edge 62 may be at an angle less than normal to planar surfaces 25 and 60 to assist in retaining stirrup 1 on support 21. Lip 64 and edge 62 may lie at an angle of 85° with respect to the planar surfaces. Lip 64 may also contain upwardly extending dimples 66, as shown in FIG. 9, for further assisting the retention of stirrup 1 on support 21, as in the absence of biasing means clip 31.

Spring steel clip 31 has legs 32 and 33 and resilient bight 34. The bight 34 of clip 31 passes through aperture 23 and is spaced from support 21 and stirrup 1. Legs 32 and 33 are slipped over stirrup 1 and support means 21 to biasingly lie on surface 8 of stirrup 1 and surface 26 of support 21. Leg 33 terminates short of lip 64 as shown in FIG. 8.

Support 21 may be bent at the top of bight 5, also as shown in FIG. 8, to facilitate the pivoting of support 21 and stirrup 1, as indicated in phantom. A return bend may be used to align the upper portion of support 21 with the lower portion while offsetting the former from the latter.

The operation of the stirrup shown in FIGS. 8 and 9 is similar to that described in connection with the embodiments shown in FIGS. 1 through 7.

FIG. 10 shows the embodiment of the invention shown in FIGS. 8 and 9 used in connection with a stirrup of Western or American style.

The claims form part of the disclosure of this specification.

Modifications and adaptations may be made to the above described without departing from the spirit and scope of this invention which includes every novel feature and combination of features disclosed herein.

I claim:

1. A stirrup safety device comprising:

a stirrup having a planar surface on the side of the bight thereof, said stirrup having an edge adjacent said planar surface:

a support for said stirrup having a plate-like portion with a planar surface and a portion adapted to receive a stirrup leather, said planar surface of said support being abuttable along only one side of said bight at the planar surface thereof; said plate-like portion of said stirrup support having a lip lying generally normal to the plate-like portion, the length of said lip corresponding generally to the thickness of said stirrup bight, said stirrup being positionable on said support with said edge resting on said lip and said planar surfaces in abutment; and biasing means in the form of a U-shaped spring clip having two legs and a joinder portion, one of said legs contacting the bight of said stirrup and terminating short of said lip, the other of said legs contacting the plate-like portion of said support for biasing said planar surfaces of said stirrup and support into abutment with said lip and said edge in engagement so that said stirrup depends from said support, said biasing means being separable from said support and said stirrup, said safety device being constructed and arranged such that in normal use with force applied to the stirrup by a rider, the stirrup will be supported by the support but such that when forces are applied to the stirrup at an angle to the support, the stirrup and support will pivot relative to one another against the biasing means until disengagement of the lip and the edge occur, whereupon the stirrup becomes separable from the support.

2. A safety device as claimed in claim 1 wherein said planar surface of said support is bent to form said lip.

3. A safety device as claimed in claim 1 wherein said support has a perforation through which said bias means extends and said bias means is spaced from said support in said perforation.

4. A safety device as claimed in claim 1 wherein said lip lies at an angle less than normal to said planar surface of said support and wherein said edge of said stirrup lies at a corresponding angle with respect to said planar surface of said stirrup.

5. A safety device as claimed in claim 4 wherein said lip and edge lie at an angle of approximately 85° with respect to said planar surfaces.

6. A safety device as claimed in claim 1 wherein said lip has projection means adjacent the terminus thereof for assisting the retention of said stirrup on said support.

7. A safety device as claimed in claim 6 wherein said projection means comprises dimples extending toward said edge when said support and stirrup are assembled.

8. A safety device as claimed in claim 1 wherein said stirrup is generally vertical in use and wherein said stirrup support is bent along the top of said bight to facilitate the pivoting of said stirrup and support.

9. A safety device as claimed in claim 8 wherein the bend in said stirrup support moves the portion receiving the stirrup leather out of alignment with said plate-like portion.

10. A safety device as claimed in claim 9 wherein said stirrup leather receiving portion is parallel to said plate-like portion.

* * * * *